US008708037B2

(12) United States Patent
Tokizaki et al.

(10) Patent No.: US 8,708,037 B2
(45) Date of Patent: Apr. 29, 2014

(54) CONDENSER

(75) Inventors: Kazumi Tokizaki, Oyama (JP); Takayuki Fujii, Oyama (JP); Yoshihiko Seno, Oyama (JP); Shingo Suzuki, Oyama (JP)

(73) Assignee: Showa Denko K.K., Tokyo (JP)

( * ) Notice: Subject to any disclaimer, the term of this patent is extended or adjusted under 35 U.S.C. 154(b) by 397 days.

(21) Appl. No.: 13/064,698

(22) Filed: Apr. 11, 2011

(65) Prior Publication Data

US 2011/0253353 A1 Oct. 20, 2011

(30) Foreign Application Priority Data

Apr. 20, 2010 (JP) ..... 2010-096635
Mar. 17, 2011 (JP) ..... 2011-059088

(51) Int. Cl.
*F28F 9/02* (2006.01)
*F25B 39/04* (2006.01)

(52) U.S. Cl.
USPC ..... 165/175; 165/174; 62/509

(58) Field of Classification Search
CPC ..... F25B 39/04; F25B 40/02
USPC ..... 165/173, 174, 175, 176; 62/509
See application file for complete search history.

(56) References Cited

U.S. PATENT DOCUMENTS

| | | | | | |
|---|---|---|---|---|---|
| 4,936,379 | A * | 6/1990 | Hoshino et al. | ..... | 165/150 |
| 4,977,956 | A * | 12/1990 | Aoki et al. | ..... | 165/176 |
| 5,168,925 | A * | 12/1992 | Suzumura et al. | ..... | 165/176 |
| 5,537,839 | A * | 7/1996 | Burk et al. | ..... | 62/474 |
| 5,765,633 | A * | 6/1998 | Hu | ..... | 165/174 |
| 6,622,517 | B1 * | 9/2003 | Whitlow et al. | ..... | 62/474 |
| 2011/0186277 | A1 * | 8/2011 | Hanafusa | ..... | 165/173 |

FOREIGN PATENT DOCUMENTS

JP 3-31266 3/1991

* cited by examiner

*Primary Examiner* — Tho V Duong
(74) *Attorney, Agent, or Firm* — Edwards Wildman Palmer LLP; James E. Armstrong, IV; George N. Chaclas

(57) ABSTRACT

A condenser has, at one end, a first header tank to which first heat exchange tubes of third and fourth heat exchange paths are connected and a second header tank to which second heat exchange tubes of first and second heat exchange paths are connected. The upper end of the first header tank is located above the lower end of the second header tank. The first header tank has a branching control section promoting a flow of liquid-phase refrigerant from the first header tank into the first heat exchange tubes of the fourth heat exchange path. The branching control section includes a space forming member which forms a closed refrigerant inflow space communicating with the first heat exchange tubes, and a liquid accumulation space. The space forming member has a communication portion for communication between a lower portion of the refrigerant inflow space and the liquid accumulation space.

8 Claims, 9 Drawing Sheets

CONDENSER

CROSS REFERENCE TO RELATED APPLICATIONS

This application claims priority to Japanese Application Nos. 2010-096635 and 2011-059088, filed Apr. 20, 2010 and Mar. 17, 2011, respectively; each of the above-identified applications is incorporated by reference herein. This application is also related to co-pending applications, both entitled, "CONDENSER" filed concurrently herewith in the names of Shingo SUZUKI, Kazumi TOKIZAKI, Yoshihiko SENO and Takayuki FUJII, which claims priority to Japanese Application No. 2010-094804 and 2011-049913, filed Apr. 16, 2010 and Mar. 8, 2011, respectively, and which claims priority to Japanese Application No. 2010-094800 and 2011-049912, filed Apr. 16, 2010 and Mar. 8, 2011, respectively, each of which application is assigned to the assignee of the instant application and which co-pending application is also incorporated by reference herein.

BACKGROUND OF THE INVENTION

The present invention relates to a condenser suitable for use in, for example, a car air conditioner, which is a refrigeration cycle mounted on an automobile.

Further, herein and in the appended claims, the upper side, lower side, left-hand side, and right-hand side of FIG. 1 will be referred to as "upper," "lower," "left," and "right," respectively.

A condenser for a car air conditioner is known (see Japanese Utility Model Application Laid-Open (kokai) No. H3-31266). The known condenser includes a plurality of heat exchange tubes disposed in parallel such that they are spaced apart from one another in a vertical direction; and header tanks which extend in the vertical direction and to which left and right end portions of the heat exchange tubes are connected, respectively. Three heat exchange paths each formed by a plurality of heat exchange tubes successively arranged in the vertical direction are provided such that the three heat exchange paths are juxtaposed in the vertical direction. Refrigerant flows in the same direction through all the heat exchange tubes which form each heat exchange path, and the flow direction of refrigerant flowing through the heat exchange tubes which form one of two adjacent heat exchange paths is opposite the flow direction of refrigerant flowing through the heat exchange tubes which form the other heat exchange path. A first header tank and a second header tank are individually provided at the left end or right end. The heat exchange tubes which form the heat exchange path at the lower end are connected to the first header tank. The heat exchange tubes which form the heat exchange paths other than the lower-end heat exchange path are connected to the second header tank. The second header tank is disposed above the first header tank. The thickness (diameter) of the first header tank is rendered considerably larger than that of the second header tank, and a desiccant is disposed within the first header tank. Thus, the first header tank functions as a liquid receiver which separates gas and liquid from each other by making use of gravitational force and stores the separated liquid. The first heat exchange tubes connected to the first header tank are equal in length to the second heat exchange tubes connected to the second header tank, and the ends of the first heat exchange tubes on the side toward the first header tank and the ends of the second heat exchange tubes on the side toward the second header tank are located on the same vertical line. All the heat exchange paths serve as refrigerant condensation paths for condensing refrigerant.

In the condenser disclosed in the publication, the internal volume of the first header tank must be rendered considerably large as compared with that of the second header tank, in order to effectively perform gas liquid separation within the first header tank. Therefore, the thickness of the first header tank is considerably large as compared with the second header tank, which raises a problem in that a large space is required for installing the condenser.

In general, other devices are disposed in the vicinity of a condenser. In the case of the condenser disclosed in the publication, the first header tank hinders installation of other devices. For example, a radiator is typically disposed downstream (with respect to an air passage direction) of a condenser for a car air conditioner. If the condenser disclosed in the publication is used, the first header tank hinders installation of the radiator. As a result, a wasteful space is produced within an engine compartment, which makes space saving difficult. In addition, since the heat exchange tubes are connected over substantially the entire length of the first header tank, the conventional condenser has a problem in that its gas liquid separation performance is not satisfactory.

SUMMARY OF THE INVENTION

An object of the present invention is to solve the above-mentioned problem and to provide a condenser which can reduce installation space as compared with the condenser disclosed in the above-mentioned publication, and in which the amount of refrigerant charged into a refrigeration cycle can be increased to a proper level in an early stage.

To achieve the above object, the present invention comprises the following modes.

1) A condenser comprising a plurality of heat exchange tubes disposed in parallel such that the heat exchange tubes are spaced apart from one another in a vertical direction and extend in a left-right direction; and header tanks which extend in the vertical direction and to which left and right end portions of the heat exchange tubes are connected, in which three or more heat exchange paths each formed by a plurality of heat exchange tubes successively arranged in the vertical direction are juxtaposed in the vertical direction, wherein the condenser has a group composed of at least two heat exchange paths which are successively arranged and which include a heat exchange path at an upper end, and at least one heat exchange path is provided below the group;

in the group, refrigerant is caused to flow from a heat exchange path at one of upper and lower ends toward a heat exchange path at the other end;

first and second header tanks are provided at a left or right end of the condenser, first heat exchange tubes which form a heat exchange path located on the downstreammost side of the group with respect to a refrigerant flow direction and first heat exchange tubes which form the heat exchange path located below the group being connected to the first header tank, and second heat exchange tubes which form all the remaining heat exchange path(s) being connected to the second header tank;

the first header tank is disposed on the outer side of the second header tank with respect to the left-right direction, has an upper end located above a lower end of the second header tank, and has a function of separating gas and liquid from each other and storing the liquid;

all the heat exchange paths of the group are refrigerant condensation paths for condensing refrigerant, and the heat exchange path located below the group is a refrigerant super-cooling path for super-cooling refrigerant; and the first header tank includes branching control means for promoting a flow of liquid-phase refrigerant from the first header tank into the first heat exchange tubes which constitute the refrigerant super-cooling path.

2) A condenser according to par. 1), wherein the branching control means includes a space forming member which forms a closed refrigerant inflow space which is provided at an inner side, with respect to the left-right direction, of the interior of the first header tank to be located at a height corresponding to the refrigerant super-cooling path adjacent to the group, which communicates with the first heat exchange tubes of the refrigerant super-cooling path, and from which refrigerant flows into the first heat exchange tubes, and a liquid accumulation space which is provided within the first header tank to be located on the outer side of the refrigerant inflow space with respect to the left-right direction, and which communicates with a portion of the interior of the first header tank extending upward beyond the lower end of the second header tank; and a communication portion which establishes communication between a lower portion of the refrigerant inflow space and the liquid accumulation space is provided in the space forming member.

3) A condenser according to par. 2), wherein the space forming member includes a partition wall whose longitudinal direction coincides with the vertical direction and which divides the interior of the first header tank into inner and outer portions with respect to the left-right direction, and upper and lower closing walls which are provided at upper and lower ends of the partition wall and which close upper and lower end openings of the space located on the inner side of the partition wall with respect to the left-right direction; the refrigerant inflow space is formed by the partition wall and the upper and lower closing walls; and the communication portion, which establishes communication between the lower portion of the refrigerant inflow space and the liquid accumulation space, includes a communication hole formed in the partition wall in the form of a through hole.

4) A condenser according to par. 2) or 3), wherein the communication portion is provided below a vertical center of a vertical range in which the first heat exchange tubes communicating with the refrigerant inflow space are disposed.

5) A condenser according to par. 2), wherein the space forming member includes a partition wall whose longitudinal direction coincides with the vertical direction and which divides the interior of the first header tank into inner and outer portions with respect to the left-right direction, and upper and lower closing walls which are provided at upper and lower ends of the partition wall and which close upper and lower end openings of the space located on the inner side of the partition wall with respect to the left-right direction; the refrigerant inflow space is formed by the partition wall and the upper and lower closing walls; and the communication portion, which establishes communication between the lower portion of the refrigerant inflow space and the liquid accumulation space, includes a communication hole formed in the lower closing wall in the form of a through hole.

6) A condenser according to par. 1), wherein refrigerant is caused to flow from a heat exchange path at the upper end of the group toward a heat exchange path at the lower end of the group;

the lower end of the first header tank is located below the lower end of the second header tank; and the first heat exchange tubes which constitute the lower-end heat exchange path of the group and the heat exchange path located below the group are connected to a portion of the first header tank located below the second header tank.

7) A condenser according to par. 1), wherein the first heat exchange tubes which form two heat exchange paths are connected to the first header tank, and the second heat exchange tubes which form at least two heat exchange paths are connected to the second header tank.

According to the condensers of pars. 1) to 7), the condenser has a group composed of at least two heat exchange paths which are successively arranged and which include a heat exchange path at an upper end, and at least one heat exchange path is provided below the group. In the group, refrigerant is caused to flow from a heat exchange path at one of upper and lower ends toward a heat exchange path at the other end. First and second header tanks are provided at a left or right end of the condenser. First heat exchange tubes which form a heat exchange path located on the downstreammost side of the group with respect to a refrigerant flow direction and first heat exchange tubes which form the heat exchange path located below the group are connected to the first header tank. Second heat exchange tubes which form all the remaining heat exchange path(s) are connected to the second header tank. The first header tank is disposed on the outer side of the second header tank with respect to the left-right direction, has an upper end located above a lower end of the second header tank, and has a function of separating gas and liquid from each other and storing the liquid. Therefore, as compared with the condenser disclosed in the above-mentioned publication, the internal volume of the first header tank can be increased so as to effectively perform gas liquid separation, for example, by extending the upper end of the first header tank upward to the vicinity of the upper end of the second header tank, without making the thickness of the first header tank greater than that of the second header tank. Accordingly, a space for installing the condenser can be made smaller as compared with the condenser disclosed in the above-mentioned publication. As a result, space saving becomes possible. In addition, since a relatively large space is present above a portion of the first header tank to which heat exchange tubes are connected, the gas liquid separation action by gravitational force becomes excellent.

Furthermore, all the heat exchange paths of the group are refrigerant condensation paths for condensing refrigerant, and the heat exchange path located below the group is a refrigerant super-cooling path for super-cooling refrigerant; and the first header tank includes branching control means for promoting a flow of liquid-phase refrigerant from the first header tank into the first heat exchange tubes which constitute the refrigerant super-cooling path. Therefore, at the time of charging of refrigerant, liquid-phase refrigerant quickly flows from the first header tank into the first heat exchange tubes which constitute the refrigerant super-cooling path. Accordingly, the interiors of the first heat exchange tubes of the refrigerant super-cooling path can be filled with the liquid-phase refrigerant at an early stage, and the amount of refrigerant charged into the refrigeration cycle can be increased, at an early stage, to a proper level at which the degree of super-cooling becomes constant. In addition, the width of a stabilized range in which the degree of super-cooling becomes constant; i.e., a range of the refrigerant charging amount which renders the degree of super-cooling constant, becomes wider, whereby a super-cooling characteristic which is more stable against variation of load and leakage of refrigerant can be obtained.

According to the condenser of par. 2), the pressure within the liquid accumulation space, which communicates with the portion of the interior of the first header tank extending upward beyond the lower end of the second header tank, becomes higher than that within the refrigerant inflow space. Therefore, before the level of the liquid-phase refrigerant having accumulated within the liquid accumulation space reaches a point above the upper-end first heat exchange tube of the refrigerant super-cooling path adjacent to the group, the refrigerant inflow space can be filled with the liquid-phase refrigerant, and the interiors of the first heat exchange tubes which constitute the refrigerant super-cooling path can be filled with the liquid-phase refrigerant. Accordingly, the interiors of the first heat exchange tubes of the refrigerant super-cooling path can be filled with the liquid-phase refrigerant at an early stage, and the amount of refrigerant charged into the refrigeration cycle can be increased, at an early stage, to a proper level at which the degree of super-cooling becomes constant.

According to the condenser of par. 3), the space forming member of the branching control means can be formed relatively simply.

According to the condenser of par. 7), refrigerant flows into the first header tank from a plurality of heat exchange tubes which constitute the refrigerant condensation path located at the lower end, and gas liquid separation is performed within the first header tank. Therefore, it is possible to suppress a drop in pressure, to thereby prevent re-vaporization of liquid-phase refrigerant.

Moreover, according to the condenser of par. 7), refrigerant flows into the first header tank from a plurality of heat exchange tubes which form the refrigerant condensation path located at the lower end, and gas liquid separation is performed within the first header tank. Therefore, the gas liquid separation can be performed efficiently within the first header tank. That is, gas-liquid mixed phase refrigerant whose gas phase component is large in amount flows through upper-side heat exchange tubes among a plurality of heat exchange tubes which form the refrigerant condensation path, and gas-liquid mixed phase refrigerant whose liquid phase component is large in amount flows through lower-side heat exchange tubes among the plurality of heat exchange tubes. Since these gas-liquid mixed phase refrigerants flow into the first header tank without mixing, gas liquid separation can be performed efficiently.

DESCRIPTION OF THE PREFERRED EMBODIMENTS

Embodiments of the present invention will next be described with reference to the drawings.

Figure 1:
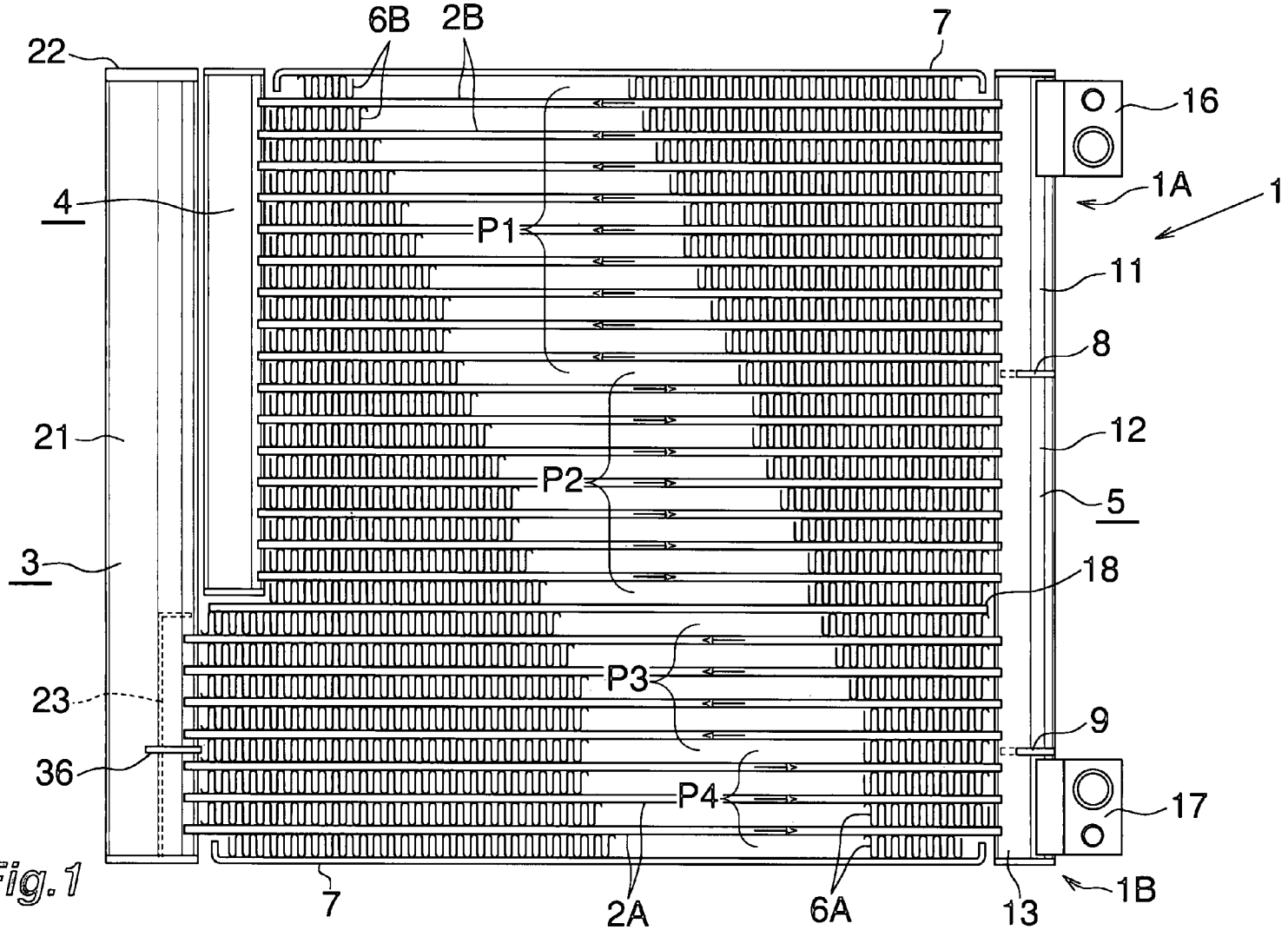
FIG. 1 is a front view specifically showing the overall structure of a first embodiment of the condenser according to the present invention.

In the following description, the reverse side of a sheet on which FIG. 1 is drawn (the upper side in FIG. 4) will be referred to as the "front," and the opposite side as the "rear."

Furthermore, the term "aluminum" as used in the following description encompasses aluminum alloys in addition to pure aluminum.

Figure 2:
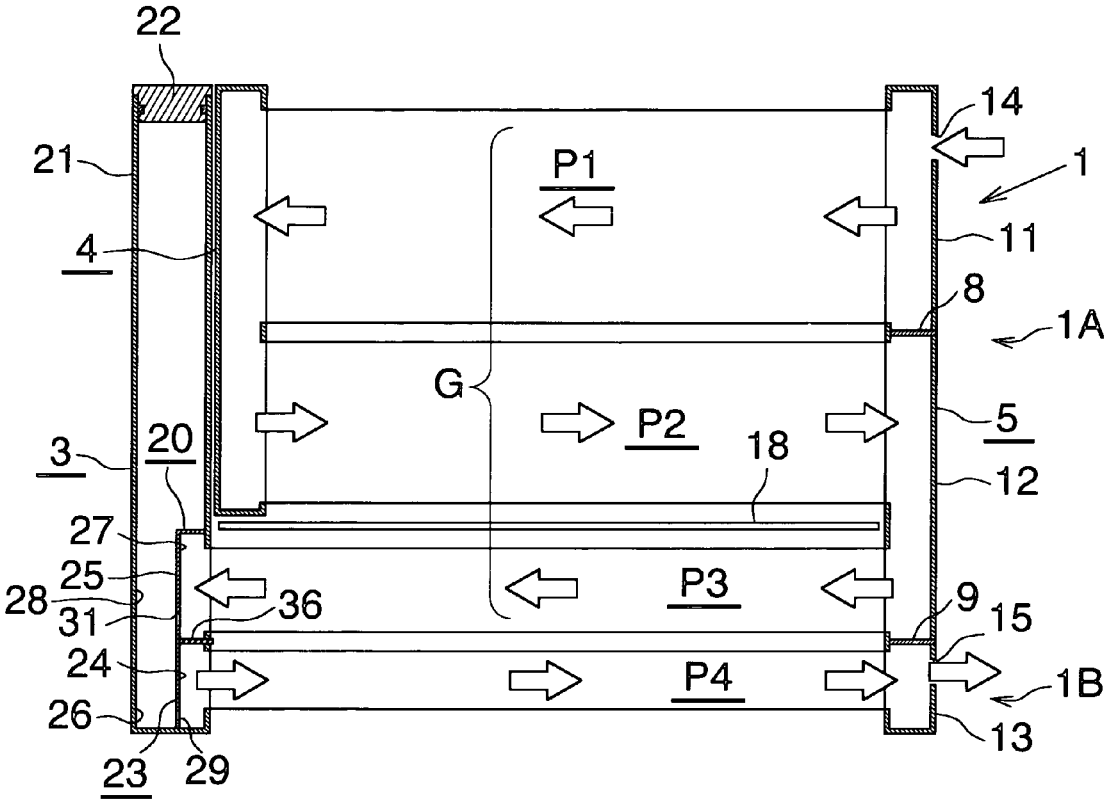
FIG. 2 is a front view schematically showing the condenser of FIG. 1.
Figure 3:
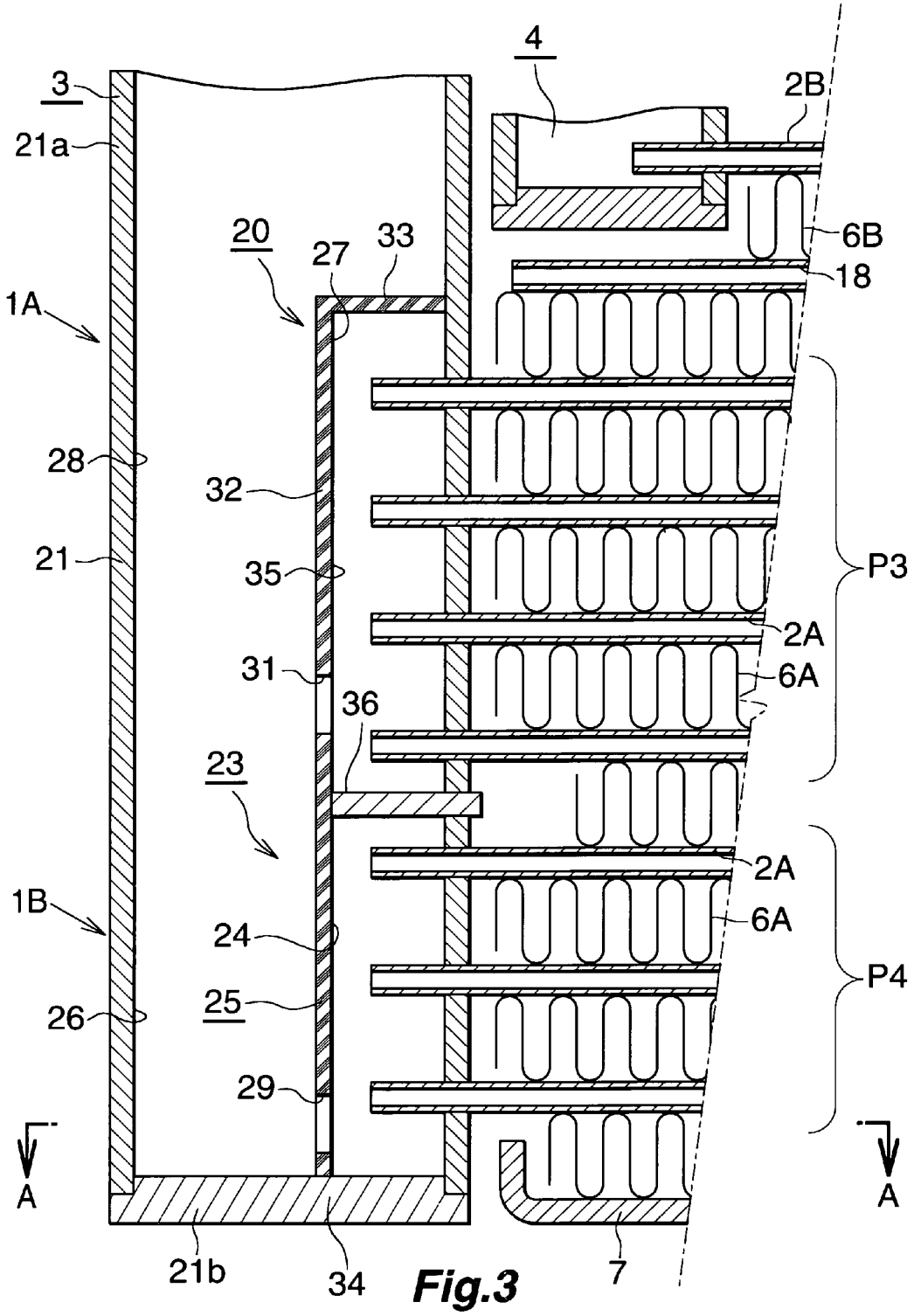
FIG. 3 is a partially omitted vertical sectional view showing, on an enlarged scale, a portion of a first header tank of the condenser shown in FIG. 1.
Figure 4:
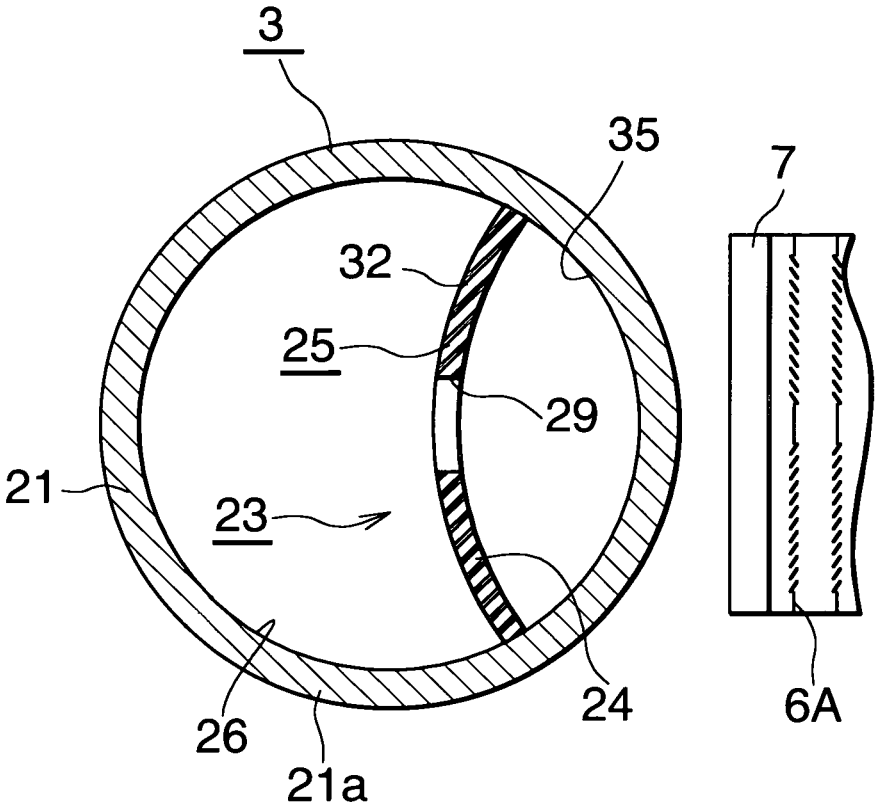
FIG. 4 is a sectional view taken along line A=A of FIG. 3.

FIG. 1 specifically shows the overall structure of a first embodiment of the condenser according to the present invention; and FIG. 2 schematically shows the condenser of FIG. 1. In FIG. 2, individual heat exchange tubes are omitted, and corrugate fins, side plates, a refrigerant inlet member, and a refrigerant outlet member are also omitted. FIGS. 3 and 4 show the structure of a main portion of the condenser of FIG. 1.

In FIGS. 1 and 2, a condenser 1 includes a plurality of flat heat exchange tubes 2A, 2B formed of aluminum, three header tanks 3, 4, 5 formed of aluminum, corrugate fins 6A, 6B formed of aluminum, and side plates 7 formed of aluminum. The heat exchange tubes 2A, 2B are disposed such that their width direction coincides with a front-rear direction, their length direction coincides with a left-right direction, and they are spaced from one another in a vertical direction. Left and right end portions of the heat exchange tubes 2A, 2B are connected, by means of brazing, to the header tanks 3, 4, 5, which extend in the vertical direction. Each of the corrugate fins 6A, 6B is disposed between and brazed to adjacent heat exchange tubes 2A, 2B, or is disposed on the outer side of the uppermost or lowermost heat exchange tube 2A, 2B and brazed to the corresponding heat exchange tube 2A, 2B. The side plates 7 are disposed on the corresponding outer sides of the uppermost and lowermost corrugate fins 6A, 6B, and are brazed to these corrugate fins 6A, 6B. Three or more heat exchange paths (in the present embodiment, four heat exchange paths P1, P2, P3, P4) each formed by a plurality of heat exchange tubes 2A, 2B successively arranged in the vertical direction are juxtaposed in the vertical direction. The four heat exchange paths will be referred to as the first to fourth heat exchange paths P1, P2, P3, P4 from the upper side. The flow direction of refrigerant is the same among all the heat exchange tubes 2A, 2B which form the respective heat exchange paths P1, P2, P3, P4. The flow direction of refrigerant in the heat exchange tubes 2A, 2B which form a certain heat exchange path is opposite the flow direction of refrigerant in the heat exchange tubes 2A, 2B which form another heat exchange path adjacent to the certain heat exchange path.

That is, the condenser 1 includes a group G composed of at least two heat exchange paths which are successively arranged and which include the first heat exchange path P1 at the upper end (in the present embodiment, the first through third heat exchange paths P1, P2, P3), and at least one heat exchange path (in the present embodiment, the fourth heat exchange path P4) is provided below the group G. In the group G composed of the first through third heat exchange paths P1, P2, P3, refrigerant flows from the first heat exchange path P1 at the upper end toward the third heat exchange path P3 at the lower end.

A first header tank 3 and a second header tank 4 are individually provided at the left end of the condenser 1. The heat exchange tubes 2A, which form the lower-end heat exchange path located on the downstreammost side of the group G with respect to the refrigerant flow direction, and the heat exchange path located below the group G (in the present embodiment, the third and fourth heat exchange paths P3, P4), are connected to the first header tank 3 by means of brazing. The heat exchange tubes 2B, which form all the remaining heat exchange paths (in the present embodiment, the first and second heat exchange paths P1, P2), are connected to the second header tank 4 by means of brazing. Notably, the lower end of the first header tank 3 is located below the lower end of the second header tank 4, and the heat exchange tubes 2A, which form the third and fourth heat exchange paths P3, P4 are brazed to a portion of the first header tank 3 located below the second header tank 4.

The heat exchange tubes 2A connected to the first header tank 3 will be referred to as the first heat exchange tubes, and the heat exchange tubes 2B connected to the second header tank 4 will be referred to as the second heat exchange tubes. The corrugate fins 6A disposed between the adjacent first heat exchange tubes 2A and between the lower-end first heat exchange tube 2A and the lower side plate 7 will be referred to as the first corrugate fins. The corrugate fins 6B disposed between the adjacent second heat exchange tubes 2B and between the upper-end second heat exchange tube 2B and the upper side plate 7 will be referred to as the second corrugate fins.

Although the first header tank 3 and the second header tank 4 are approximately equal to each other in terms of the dimension along the front-rear direction, the first header tank 3 is greater than the second header tank 4 in terms of the horizontal cross sectional area. The first header tank 3 is disposed on the left side (on the outer side with respect to the left-right direction) of the second header tank 4. The center of the first header tank 3 with respect to the left-right direction is located on the outer side (with respect to the left-right direction) of the center of the second header tank 4 with respect to the left-right direction. The centers of the first and second header tanks 3, 4 with respect to the front-rear direction are located on a common vertical plane extending in the left-right direction. Therefore, the first header tank 3 and the second header tank 4 are offset from each other such that they do not overlap as viewed from above. The upper end of the first header tank 3 is located above the lower end of the second header tank 4. In the present embodiment, the upper end of the first header tank 3 is located at a position which is substantially the same height as the upper end of the second header tank 4. Thus, the first header tank 3 serves as a liquid receiver which separates gas and liquid from each other through utilization of gravitational force, and stores the separated liquid. That is, the internal volume of the first header tank 3 is determined such that a portion of gas-liquid mixed phase refrigerant having flowed into the first header tank 3; i.e., liquid-predominant mixed phase refrigerant, accumulates in a lower region within the first header tank 3 because of gravitational force, and the gas phase component of the gas-liquid mixed phase refrigerant accumulates in an upper region within the first header tank 3 because of gravitational force, whereby only the liquid-predominant mixed phase refrigerant flows into the first heat exchange tubes 2A of the fourth heat exchange path P4.

The third header tank 5 is disposed at the right end of the condenser 1, and all the heat exchange tubes 2A, 2B which form the first to fourth heat exchange paths P1-P4 are connected to the third header tank 5. The transverse cross sectional shape of the third header tank 5 is identical with that of the second header tank 4. The interior of the third header tank 5 is divided into an upper header section 11, an intermediate header section 12, and a lower header section 13 by aluminum partition plates 8, 9, which are provided at a height between the first heat exchange path P1 and the second heat exchange path P2 and a height between the third heat exchange path P3 and the fourth heat exchange path P4, respectively. Left end portions of the second heat exchange tubes 2B of the first heat exchange path P1 are connected to the second header tank 4, and right end portions thereof are connected to the upper header section 11 of the third header tank 5. Left end portions of the second heat exchange tubes 2B of the second heat exchange path P2 are connected to the second header tank 4, and right end portions thereof are connected to the intermediate header section 12 of the third header tank 5. Left end portions of the first heat exchange tubes 2A of the third heat exchange path P3 are connected to the first header tank 3, and right end portions thereof are connected to the intermediate header section 12 of the third header tank 5. Left end portions of the first heat exchange tubes 2A of the fourth heat exchange path P4 are connected to the first header tank 3, and right end portions thereof are connected to the lower header section 13 of the third header tank 5.

The second header tank 4, a portion of the first header tank 3 to which the first heat exchange tubes 2A of the third heat exchange path P3 are connected, the upper and intermediate header sections 11 and 12 of the third header tank 5, and the first to third heat exchange paths P1-P3 form a condensation section 1A, which condenses refrigerant. A portion of the first header tank 3 to which the first heat exchange tubes 2A of the fourth heat exchange path P4 are connected, the lower header section 13 of the third header tank 5, and the fourth heat exchange path P4 form a super-cooling section 1B, which super-cools refrigerant. Each of the first to third heat exchange paths P1-P3, which are all the heat exchange paths of the group G, serves as a refrigerant condensation path for condensing refrigerant, and the fourth heat exchange path P4, which is located below the group G, serves as a refrigerant super-cooling path for super-cooling refrigerant.

A refrigerant inlet 14 is formed at the upper header section 11 of the third header tank 5, which partially forms the condensation section 1A, and a refrigerant outlet 15 is formed at the lower header section 13 of the third header tank 5, which partially forms the super-cooling section 1B. A refrigerant inlet member 16 which communicates with the refrigerant inlet 14 and a refrigerant outlet member 17 which communicates with the refrigerant outlet 15 are joined to the third header tank 5.

An intermediate member 18 formed of aluminum and extending in the left-right direction is disposed between the upper-end first heat exchange tube 2A of the third heat exchange path P3 and the lower-end second heat exchange tube 2B of the second heat exchange path P2 such that the intermediate member 18 is separated from these heat exchange tubes 2A, 2B, and becomes substantially parallel to the heat exchange tubes 2A, 2B. A first corrugate fin 6A is disposed between the upper-end first heat exchange tube 2A of the third heat exchange path P3 and the intermediate member 18, and is brazed to the first heat exchange tube 2A and the intermediate member 18. A second corrugate fin 6B is disposed between the lower-end second heat exchange tube 2B of the second exchange path P2 and the intermediate member 18, and is brazed to the second heat exchange tube 2B and the intermediate member 18. Left and right end portions of the intermediate member 18 are located near the first header tank 3 and the third header tank 5, respectively, and are not inserted into the first header tank 3 and the third header tank 5.

The first header tank 3 is composed of a tubular main body 21 formed of aluminum, and a closing member 22. The tubular main body 21 is formed by a cylindrical tubular member having opened opposite ends, and a bottom member brazed to a lower end portion of the cylindrical tubular member. The tubular main body 21 has an opened upper end and a closed lower end. The closing member 22 is removably attached to an upper end portion of the tubular main body 21, and closes an upper end opening of the tubular main body 21.

As shown in FIGS. 3 and 4, first branching control means 20 and a second branching control means 23 are provided in the first header tank 3. The first branching control means 20 prompts a flow of liquid-phase refrigerant from the first heat exchange tubes 2A of the third heat exchange path P3 into the first header tank 3. The second branching control means 23 prompts a flow of the liquid-phase refrigerant from the first header tank 3 into the first heat exchange tubes 2A of the fourth heat exchange path P4, which is a refrigerant super-cooling path.

The first branching control means 20 and the second branching control means 23 have a space forming member 25 which forms a refrigerant outflow space 27, a communication space 28, a refrigerant inflow space 24, and a liquid accumulation space 26. The refrigerant outflow space 27 is a closed space which is provided at the inner side (with respect to the left-right direction) of the interior of the first header tank 3 to be located at a height corresponding to the third heat exchange path P3, which communicates with the first heat exchange tubes 2A of the third heat exchange path P3, and into which refrigerant flows from the first heat exchange tubes 2A of the third heat exchange path P3. The communication space 28 is provided within the first header tank 3 to be located on the outer side of the refrigerant outflow space 27 with respect to the left-right direction, and establishes communication between a portion of the interior of the first header tank 3 extending upward beyond the lower end of the second header tank 4, and the liquid accumulation space 26 to be described later. The refrigerant inflow space 24 is a closed space which is provided at the inner side (with respect to the left-right direction) of the interior of the first header tank 3 to be located at a height corresponding to the fourth heat exchange path P4 (a refrigerant super-cooling path adjacently located on the lower side of the group G), which communicates with the first heat exchange tubes 2A of the fourth heat exchange path P4, and from which refrigerant flows into the first heat exchange tubes 2A. The liquid accumulation space 26 is provided within the first header tank 3 to be located on the outer side of the refrigerant inflow space 24 with respect to the left-right direction, and communicates, via the communication space 28, with the portion of the interior of the first header tank 3 extending upward beyond the lower end of the second header tank 4. Preferably, the internal volume of the refrigerant inflow space 24 is equal to or greater than the total of the internal volumes of all the refrigerant passages of all the first heat exchange tubes 2A of the fourth heat exchange path P4. The space forming member 25 has a throttle portion 31 which has a throttle function and which establishes communication between a lower portion of the refrigerant outflow space 27 and the communication space 28, and a communication portion 29 which establishes communication between a lower portion of the refrigerant inflow space 24 and the liquid accumulation space 26. The throttle portion 31 is provided below the vertical center of a vertical range in which the first heat exchange tubes 2A of the third heat exchange path P3 communicating with the refrigerant outflow space 27 are disposed. The communication portion 29 is provided below the vertical center of a vertical range in which the first heat exchange tubes 2A of the fourth heat exchange path P4 communicating with the refrigerant inflow space 24 are disposed.

The space forming member 25 is composed of a partition wall 32, a top wall 33, a bottom wall 34, and a dividing wall 36. The partition wall 32, which has an arcuate horizontal cross section, is disposed such that its longitudinal direction coincides with the vertical direction, and opposite side edges with respect to the air passage direction come into contact with the inner circumferential surface of a circumferential wall 21*a* of the tubular main body 21 of the first header tank 3 at positions on the opposite sides of the first heat exchange tubes 2A with respect to the air passage direction, and divides the interior of the first header tank 3 into inner and outer portions with respect to the left-right direction. The top wall 33 and the bottom wall 34 are provided at the upper and lower ends of the partition wall 32 and close upper and lower end openings of a space 35 between the partition wall 32 and an inner portion (with respect to the left-right direction) of the circumferential wall 21*a* of the tubular main body 21 of the first header tank 3. The dividing wall 36 is provided at a center portion of the partition wall 32 with respect to the vertical direction, and divides the space 35 in the vertical direction. The upper end of the partition wall 32 is located above the first heat exchange tube 2A at the upper end of the third heat exchange path P3, and the lower end of the partition wall 32 is located below the first heat exchange tube 2A at the lower end of the fourth heat exchange path P4. In the present embodiment, the lower end of the partition wall 32 rests on the bottom wall 21*b* of the tubular main body 21, and a portion of the bottom wall 21*b* of the tubular main body 21 serves as the above-mentioned bottom wall 34. An upper portion of the partition wall 32, the top wall 33, and the dividing wall 36 form the refrigerant outflow space 27. The top wall 33 serves an upper closing wall of the space forming member 25 which closes the upper end of the refrigerant outflow space 27, and the dividing wall 36 serves as a lower closing wall of the space forming member 25 which closes the lower end of the refrigerant outflow space 27. The throttle portion 31 in the form of a through throttle hole is formed in the partition wall 32 at a portion slightly above the dividing wall 36. Furthermore, a lower portion of the partition wall 32, the bottom wall 34, and the dividing wall 36 form the refrigerant inflow space 24. The dividing wall 36 serves as an upper closing wall of the space forming member 25 which closes the upper end of the refrigerant inflow space 24, and the bottom wall 31 serves as a lower closing wall of the space forming member 25 which closes the lower end of the refrigerant inflow space 24. The communication portion 29 in the form of a through communication hole is formed in a lower end portion of the partition wall 32.

Although not illustrated in the drawings, a desiccant may be disposed within the first header tank 3 to be located above the second branching control means 23.

The condenser 1 constitutes a refrigeration cycle in cooperation with a compressor, an expansion valve (pressure reducer), and an evaporator; and the refrigeration cycle is mounted on a vehicle as a car air conditioner.

In the condenser 1 having the above-described structure, gas phase refrigerant of high temperature and high pressure compressed by the compressor flows into the upper header section 11 of the third header tank 5 via the refrigerant inlet member 16 and the refrigerant inlet 14. The gas phase refrigerant is condensed while flowing leftward within the second heat exchange tubes 2B of the first heat exchange path P1, and then flows into the second header tank 4. The refrigerant having flowed into the second header tank 4 is condensed while flowing rightward within the second heat exchange tubes 2B of the second heat exchange path P2, and then flows into the intermediate header section 12 of the third header tank 5. The refrigerant having flowed into the intermediate header section 12 of the third header tank 5 is condensed while flowing leftward within the first heat exchange tubes 2A of the third heat exchange path P3, and then flows into the refrigerant outflow space 27 of the first header tank 3.

The refrigerant having flowed into the refrigerant outflow space 27 of the first header tank 3 enters the communication space 28 via the throttle portion 31. The refrigerant having entered the communication space 28 is gas-liquid mixed phase refrigerant. A portion of the gas-liquid mixed phase refrigerant; i.e., liquid-predominant mixed phase refrigerant, accumulates in the liquid accumulation space 26 within the first header tank 3 because of gravitational force. The liquid-predominant mixed phase refrigerant having accumulated in the liquid accumulation space 26 enters the refrigerant inflow pace 24 via the communication portion 29, and then enters the first heat exchange tubes 2A of the fourth heat exchange path P4.

The liquid-predominant mixed phase refrigerant having entered the first heat exchange tubes 2A of the fourth heat exchange path P4 is super-cooled while flowing rightward within the first heat exchange tubes 2A. After that, the super-cooled refrigerant enters the lower header section 13 of the third header tank 5, and flows out via the refrigerant outlet 15 and the refrigerant outlet member 17. The refrigerant is then fed to the evaporator via the expansion valve.

Meanwhile, the gas phase component of the gas-liquid mixed phase refrigerant having flowed into the communication pace 28 accumulates in an upper region within the first header tank 3.

Figure 5:
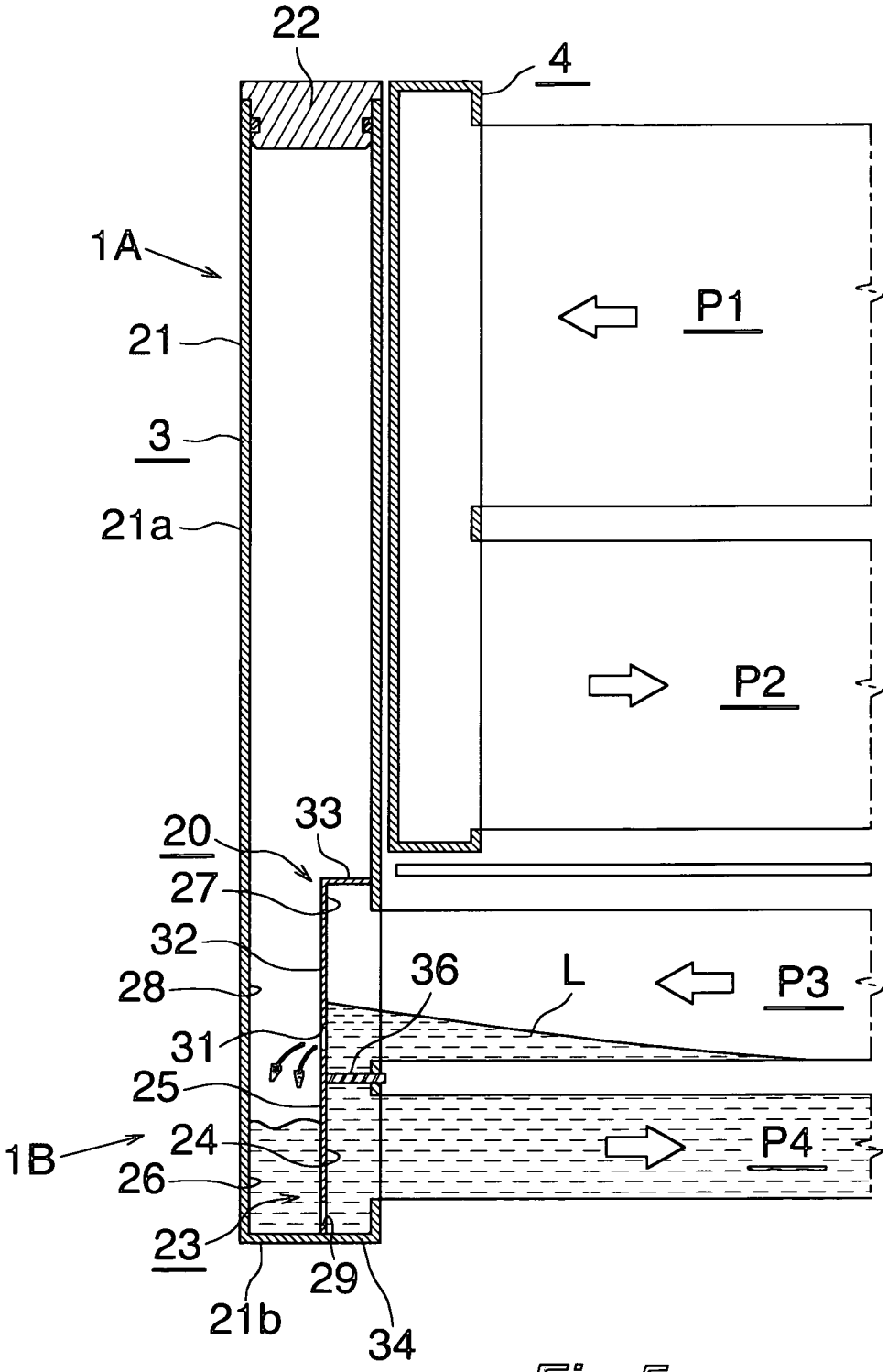
FIG. 5 is a view corresponding to a portion of FIG. 2 and schematically showing a flow of refrigerant in the condenser shown in FIG. 1 at the time when refrigerant is charged into a car air conditioner including the condenser.

When refrigerant is charged into the above-described car air conditioner, due to the action of the throttle portion 31 of the first branching control means 20 having a throttle function, the pressure within the refrigerant outflow space 27 becomes higher than that within the communication space 28 and the liquid accumulation space 26, which communicate with the portion of the interior of the first header tank 3 extending upward beyond the lower end of the second header tank 4. Therefore, as shown in FIG. 5, the liquid-phase refrigerant L within the refrigerant outflow space 27 is pushed downward. Accordingly, the liquid-phase refrigerant L quickly flows from the first heat exchange tubes 2A of the third heat exchange path P3 into the communication space 28 within the first header tank 3, whereby the amount of the liquid-phase refrigerant L remaining the first heat exchange tubes 2A which constitute the third heat exchange path P3 decreases.

Furthermore, the pressure within the liquid accumulation space 26, which communicates with the portion of the interior of the first header tank 3 extending upward beyond the lower end of the second header tank 4, becomes higher than that within the refrigerant inflow space 24. Therefore, before the level of the liquid-phase refrigerant L having accumulated in the liquid accumulation space 26 reaches a point above the upper-end first heat exchange tubes 2A of the fourth heat exchange path P4, the refrigerant inflow space 24 can be filled with the liquid-phase refrigerant L, and the interiors of the first heat exchange tubes 2A of the fourth heat exchange path P4 can be filled with the liquid-phase refrigerant L. Accordingly, the interiors of the first heat exchange tubes 2A of the refrigerant super-cooling path can be filled with the liquid-phase refrigerant L at an early stage, and the amount of refrigerant charged into the refrigeration cycle can be increased, at an early stage, to a proper level at which the degree of super-cooling becomes constant. In addition, since the amount of refrigerant charged into the refrigeration cycle can be increased, at an early stage, to a proper level at which the degree of super-cooling becomes constant, the width of a stabilized range in which the degree of super-cooling becomes constant; i.e., a range of the refrigerant charging amount which renders the degree of super-cooling constant, becomes wider, whereby a super-cooling characteristic which is more stable against variation of load and leakage of refrigerant can be obtained.

Next, an example experiment which was carried out by use of the condenser 1 having the above-described structure will be described.

Figure 6:
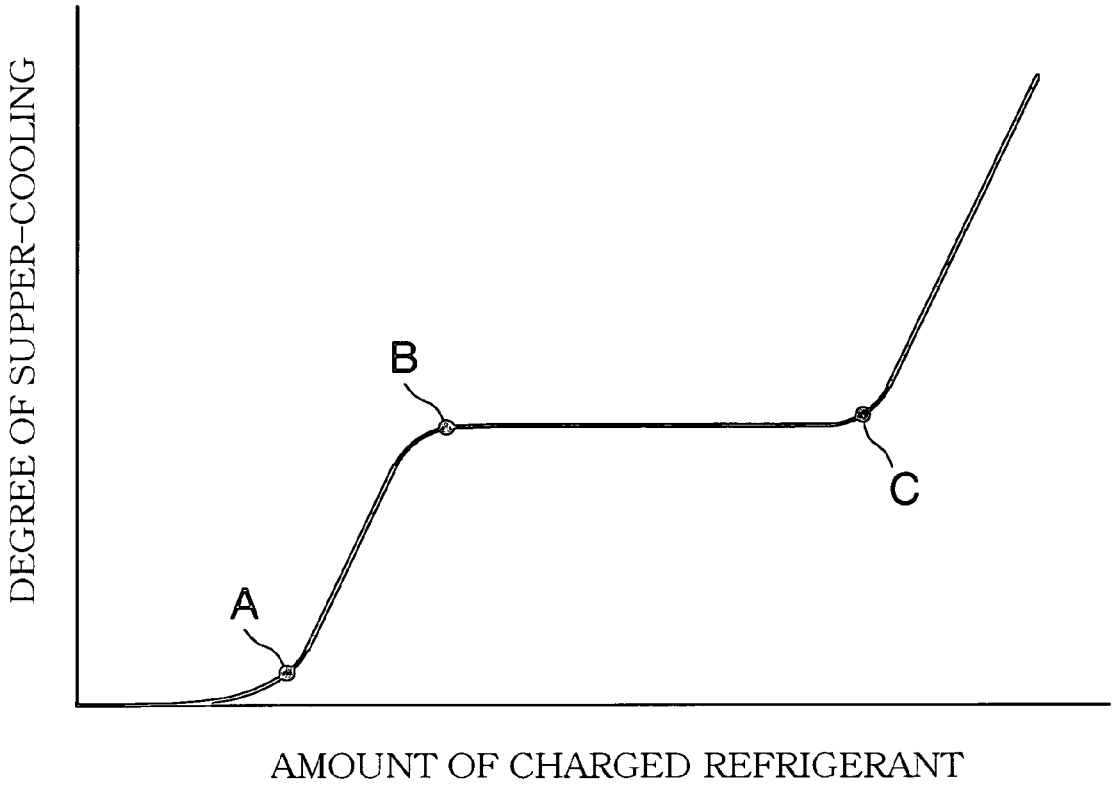
FIG. 6 is a graph showing results of an experiment performed by use of the condenser shown in FIG. 1.

A refrigeration cycle was assembled by use of the condenser 1, a compressor, an expansion valve, and an evaporator. Operation of the refrigeration cycle was started with a predetermined amount of refrigerant initially charged into the refrigeration cycle. The degrees of super-cooling at various refrigerant charged amounts were checked while the refrigerant was added, whereby a charge graph was made. FIG. 6 shows the result of the experiment. In the charge graph shown in FIG. 6, A represents a point at which super-cooling of refrigerant flowing out of the condenser 1 was started; B represents a point at which the interiors of the first heat exchange tubes 2A of the fourth heat exchange path P4 of the condenser 1 was filled with the liquid-phase refrigerant L; and C represents a point at which the interior of the first header tank 3 of the condenser 1 was filled with the liquid-phase refrigerant L. As can be understood from FIG. 6, the amount of refrigerant charged into the refrigeration cycle can be increased, at an early stage, to a proper level at which the degree of super-cooling becomes constant. In addition, since the width of a stabilized range in which the degree of super-cooling becomes constant; i.e., a range of the refrigerant charging amount which renders the degree of super-cooling constant, becomes wider, a super-cooling characteristic which is more stable against variation of load and leakage of refrigerant can be obtained.

Figure 7:
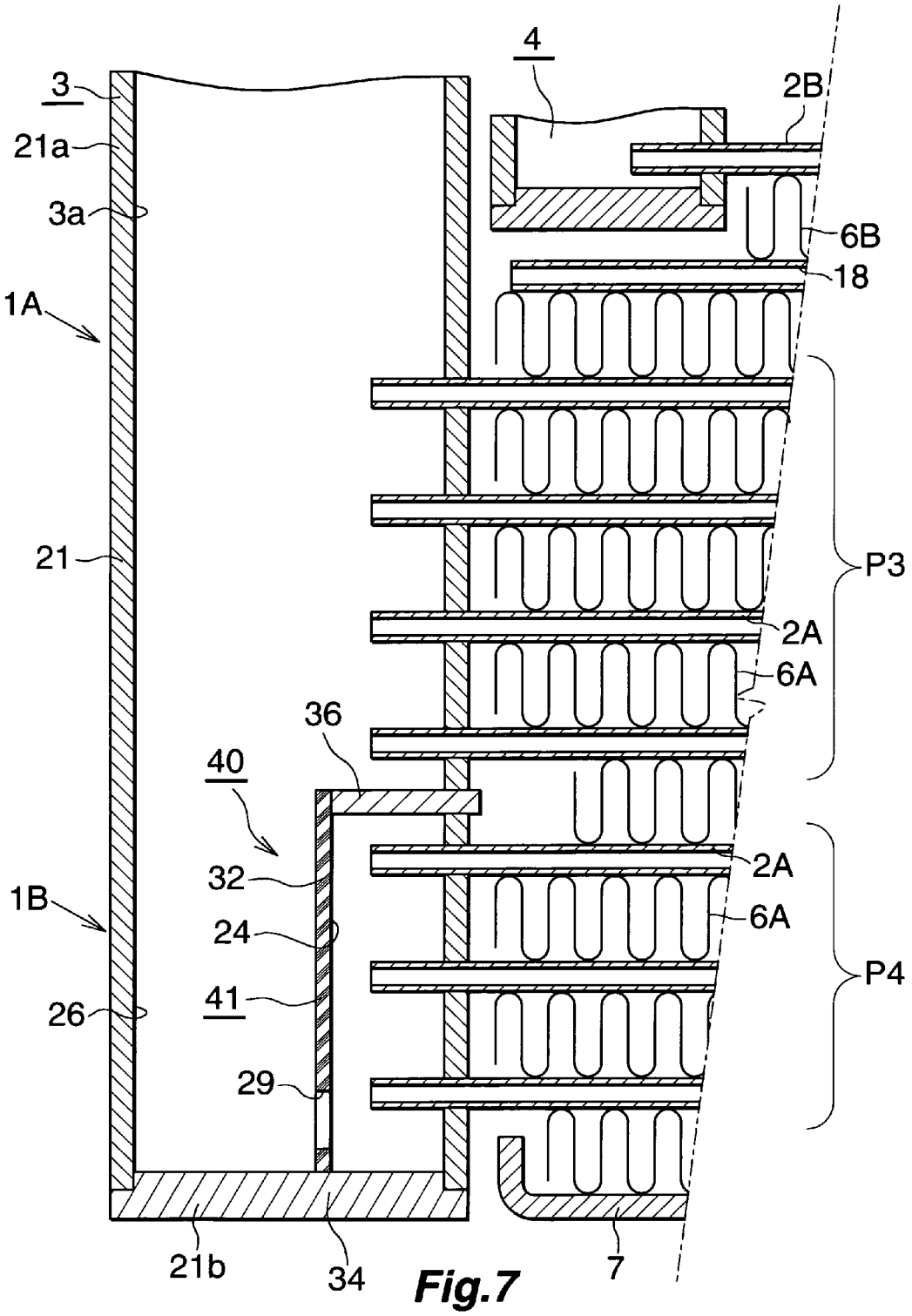
FIG. 7 is a view corresponding to FIG. 3 and showing a second embodiment of the condenser according to the present invention.

FIG. 7 shows a second embodiment of the condenser according to the present invention.

In the case of the condenser shown in FIG. 7, only branching control means 40 is provided within the first header tank 3 so as to promote the flow of liquid-phase refrigerant from the first header tank 3 into the first heat exchange tubes 2A of the fourth heat exchange path P4, which is a refrigerant super-cooling path.

The branching control means 40 includes a space forming member 41 which forms the refrigerant inflow space 24 and the liquid accumulation space 26. The refrigerant inflow space 24 is a closed space which is provided at the inner side (with respect to the left-right direction) of the interior of the first header tank 3 to be located at a height corresponding to the fourth heat exchange path P4, which communicates with the first heat exchange tubes 2A of the fourth heat exchange path P4, and from which refrigerant flows into the first heat exchange tubes 2A. The liquid accumulation space 26 is provided within the first header tank 3 to be located on the outer side of the refrigerant inflow space 24 with respect to the left-right direction, and communicates with the portion of the interior of the first header tank 3 extending upward beyond the lower end of the second header tank 4. The communication portion 29, which establishes communication between a lower portion of the refrigerant inflow space 24 and the liquid accumulation space 26, is formed in the space forming member 41 at a height below the vertical center of a vertical range in which the first heat exchange tubes 2A of the fourth heat exchange path P4 communicating with the refrigerant inflow space 24 are disposed.

The space forming member 41 is obtained from the space forming member 25 of the condenser 1 of the first embodiment by means of removing the top wall 33 and a portion of the partition wall 32 above the division wall 36.

Figure 8:
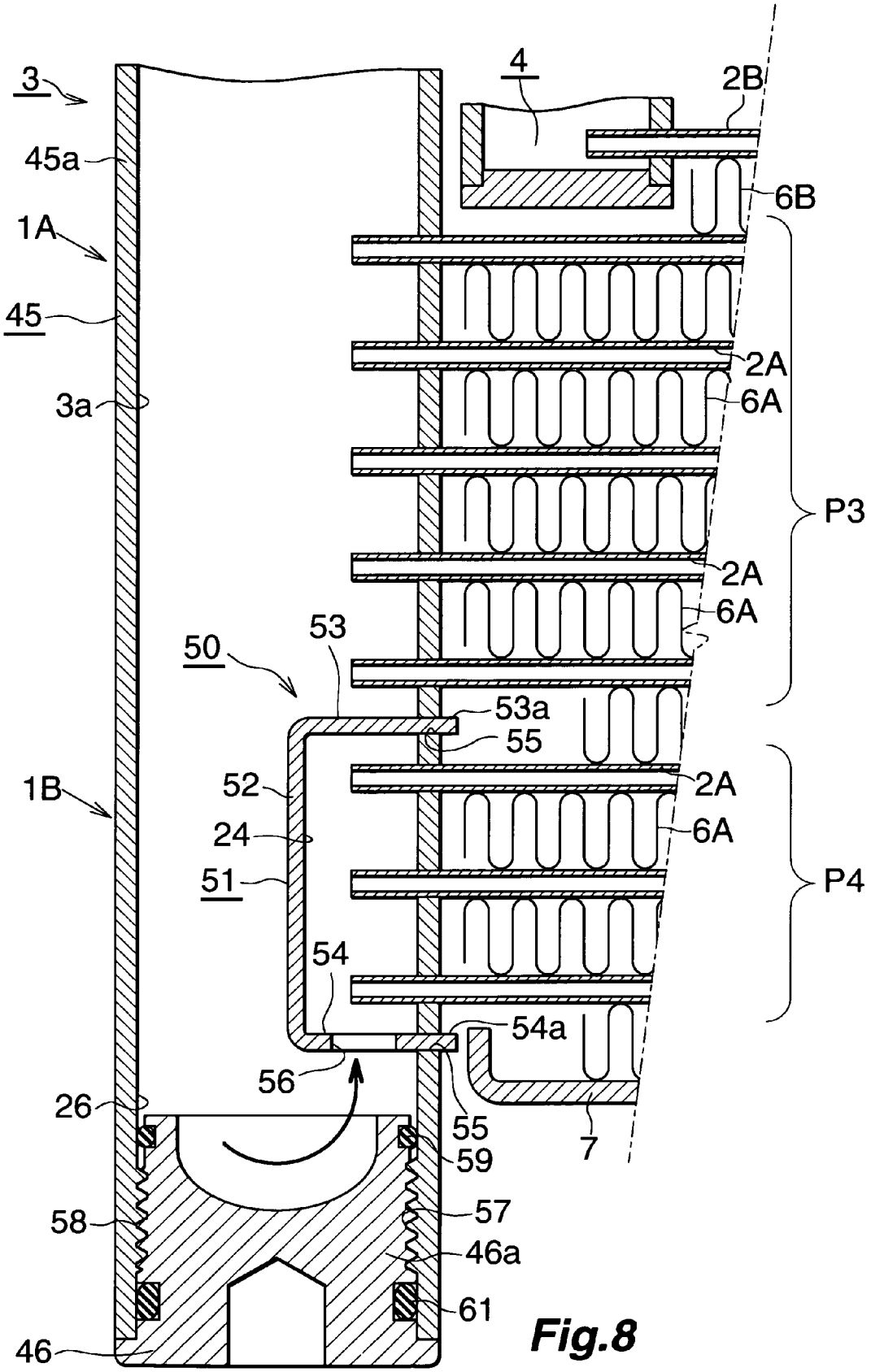
FIG. 8 is a view corresponding to FIG. 3 and showing a third embodiment of the condenser according to the present invention.
Figure 9:
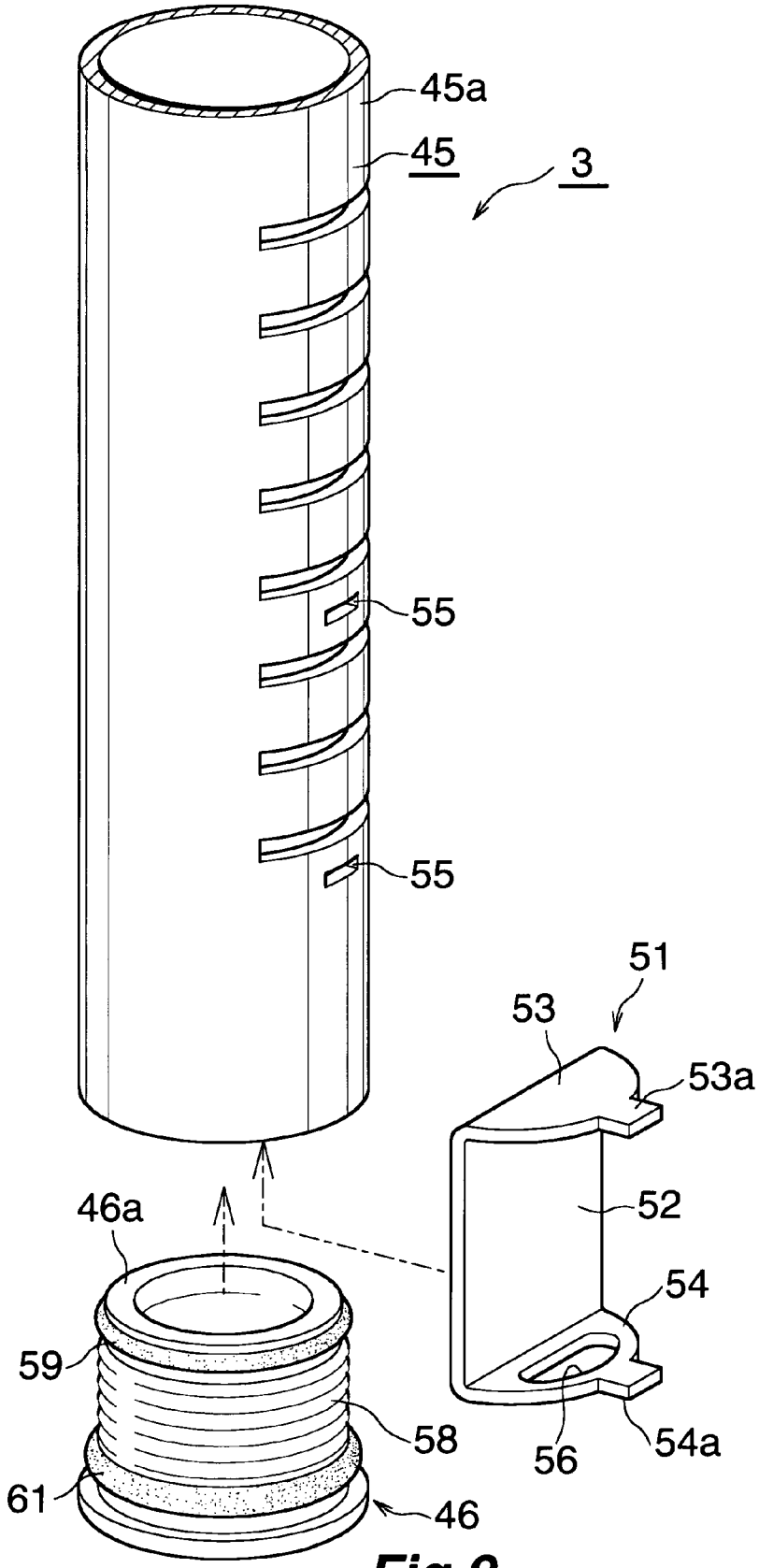
FIG. 9 is an exploded perspective view showing, on an enlarged scale, a lower portion of the first header tank of the condenser shown in FIG. 8.

FIGS. 8 and 9 show a third embodiment of the condenser according to the present invention.

In the case of the condenser shown in FIGS. 8 and 9, the first header tank 3 is composed of a tubular main body 45 formed of aluminum, and a lower closing member 46. The tubular main body 45 is formed by a cylindrical tubular member having opened opposite ends, and a lid member brazed to an upper end portion of the cylindrical tubular member. The tubular main body 45 has an opened lower end and a closed upper end. The lower closing member 46 is removably attached to a lower end portion of the tubular main body 45, and closes a lower end opening of the tubular main body 45. A lower end portion of the first header tank 3 projects downward beyond the lower side plate 7.

Only branching control means 50 is provided within the first header tank 3 so as to promote the flow of liquid-phase refrigerant from the first header tank 3 into the first heat exchange tubes 2A of the fourth heat exchange path P4, which is a refrigerant super-cooling path.

The branching control means 50 includes a space forming member 51 which forms the refrigerant inflow space 24 and the liquid accumulation space 26. The refrigerant inflow space 24 is a space which is provided at the inner side (with respect to the left-right direction) of the interior of the first header tank 3 to be located at a height corresponding to the fourth heat exchange path P4, which communicates with the first heat exchange tubes 2A of the fourth heat exchange path P4, and from which refrigerant flows into the first heat exchange tubes 2A. The liquid accumulation space 26 is provided within the first header tank 3 to be located on the outer side of the refrigerant inflow space 24 with respect to the left-right direction, and communicates with the portion of the interior of the first header tank 3 extending upward beyond the lower end of the second header tank 4.

The space forming member 51 includes a batten-shaped partition wall 52, and upper and lower closing walls 53, 54, each of which has a semi-circular shape as viewed from above. The partition wall 52 is disposed such that its longitudinal direction coincides with the vertical direction and its width direction coincides with the front-rear direction, and divides the interior of the first header tank 3 into the inner and outer portions with respect to the left-right direction. The upper and lower closing walls 53, 54 are provided at the upper and lower ends of the partition wall 52, and close the upper and lower ends of a space located on the inner side of the partition wall 52 with respect to the left-right direction. The front and rear edge portions of the partition wall 52 are brazed to a circumferential wall 45*a* of the tubular main body 45 at positions on the opposite sides of the first heat exchange tubes 2A with respect to the air passage direction. Projections 53*a*, 54*a* to be fitted into through holes 55 formed in the circumferential wall 45*a* of the tubular main body 45 of the first header thank 3 are formed at distal end portions of the upper and lower closing walls 53, 54. In a state in which the projections 53*a*, 54*a* are fitted into the through holes 55, the projections 53*a*, 54*a* and arcuate circumferential edge portions of the upper and lower closing walls 53, 54 are brazed to the circumferential wall 45*a*. A communication portion 56 in the form of a communication through hole, which establishes communication between a lower portion of the refrigerant inflow space 24 and the liquid accumulation space 26, is a communication hole formed in the lower closing wall 54 of the space forming member 51.

At a portion of the first header tank 3 projecting downward beyond the lower side plate 7, a female thread 57 is formed on the inner circumferential surface of a lower end portion of the circumferential wall 45*a* of the tubular main body 45. Furthermore, the lower closing wall 46 includes an insertion portion 46*a* which is inserted into the tubular main body 45; and a male thread 58 is formed on the outer circumferential surface of the insertion portion 46*a*. Through screw engagement between the male thread 58 of the insertion portion 46*a* and the female thread 57 of the circumferential wall 45*a*, the lower closing member 46 is removably attached to the lower end portion of the tubular main body 45. Moreover, seal rings 59, 61 are attached to the inversion portion 46*a* so as to provide sealing between portions of the outer circumferential surface of the insertion portion 46*a* of the lower closing member 46 located on the upper and lower sides of the male thread 58, and corresponding portions of the inner circumferential wall of the circumferential wall 45*a* located on the upper and lower sides of the female thread 57.

In the above-described condensers of the second and third embodiments, refrigerant having flowed into the intermediate header section 12 of the third header tank 5 flows leftward within the first heat exchange tubes 2A of the third heat exchange path P3 as in the condenser 1 of the first embodiment.

The refrigerant having been condensed while flowing leftward within the first heat exchange tubes 2A of the third heat exchange path P3 flows directly into an upper space 3*a* of the first header tank 3 located above the liquid accumulation space 26. The refrigerant having flowed into the upper space 3*a* of the first header tank 3 is gas-liquid mixed phase refrigerant. A portion of the gas-liquid mixed phase refrigerant; i.e., liquid-predominant mixed phase refrigerant, flows downward because of gravitational force, and accumulates in the liquid accumulation space 26. The gas phase component of the gas-liquid mixed phase refrigerant having flowed into the upper space 3*a* accumulates in an upper region of the upper space 3*a* of the first header tank 3.

The liquid-predominant mixed phase refrigerant having accumulated in the liquid accumulation space 26 enters the refrigerant inflow space 24 via the communication portion 29 (56), and then enters the first heat exchange tubes 2A of the fourth heat exchange path P4.

The liquid-predominant mixed phase refrigerant having entered the first heat exchange tubes 2A of the fourth heat exchange path P4 is super-cooled while flowing rightward within the first heat exchange tubes 2A, and enters the lower header section 13 of the third header tank 5. The refrigerant then flows out via the refrigerant outlet 15 and the refrigerant outlet member 17, and is fed to the evaporator via the expansion valve.

What is claimed is:

1. A condenser comprising a plurality of heat exchange tubes disposed in parallel such that the heat exchange tubes are spaced apart from one another in a vertical direction and extend in a left-right direction; and header tanks which extend in the vertical direction and to which left and right end portions of the heat exchange tubes are connected, in which three or more heat exchange paths each formed by a plurality of heat exchange tubes successively arranged in the vertical direction are juxtaposed in the vertical direction, wherein the condenser has a group composed of at least two heat exchange paths which are successively arranged and which include a heat exchange path at an upper end, and at least one heat exchange path is provided below the group;

in the group, refrigerant is caused to flow from a heat exchange path at one of upper and lower ends toward a heat exchange path at the other end;

first and second header tanks are provided separately at a left or right end of the condenser, first heat exchange tubes which form a heat exchange path located on the downstreammost side of the group with respect to a refrigerant flow direction and first heat exchange tubes which form the heat exchange path located below the group being connected to the first header tank, and second heat exchange tubes which form all the remaining heat exchange path(s) being connected to the second header tank;

the first header tank is disposed on the outer side of the second header tank with respect to the left-right direction, has an upper end located above a lower end of the second header tank, and has a function of separating gas and liquid from each other and storing the liquid;

a space for air to flow through is provided between the first and second header tanks;

all the heat exchange paths of the group are refrigerant condensation paths for condensing refrigerant, and the heat exchange path located below the group is a refrigerant super-cooling path for super-cooling refrigerant; and the first header tank includes branching control means for promoting a flow of liquid-phase refrigerant from the first header tank into the first heat exchange tubes which constitute the refrigerant super-cooling path.

2. A condenser according to claim 1, wherein the branching control means includes a space forming member which forms a closed refrigerant inflow space which is provided at an inner side, with respect to the left-right direction, of the interior of the first header tank to be located at a height corresponding to the refrigerant super-cooling path adjacent to the group, which communicates with the first heat exchange tubes of the refrigerant super-cooling path, and from which refrigerant flows into the first heat exchange tubes, and a liquid accumulation space which is provided within the first header tank to be located on the outer side of the refrigerant inflow space with respect to the left-right direction, and which communicates with a portion of the interior of the first header tank extending upward beyond the lower end of the second header tank; and a communication portion which establishes communication between a lower portion of the refrigerant inflow space and the liquid accumulation space is provided in the space forming member.

3. A condenser according to claim 2, wherein the space forming member includes a partition wall whose longitudinal direction coincides with the vertical direction and which divides the interior of the first header tank into inner and outer portions with respect to the left-right direction, and upper and lower closing walls which are provided at upper and lower ends of the partition wall and which close upper and lower end openings of the space located on the inner side of the partition wall with respect to the left-right direction; the refrigerant inflow space is formed by the partition wall and the upper and lower closing walls; and the communication portion, which establishes communication between the lower portion of the refrigerant inflow space and the liquid accumulation space, includes a communication hole formed in the partition wall in the form of a through hole.

4. A condenser according to claim 2, wherein the communication portion is provided below a vertical center of a vertical range in which the first heat exchange tubes communicating with the refrigerant inflow space are disposed.

5. A condenser according to claim 2, wherein the space forming member includes a partition wall whose longitudinal direction coincides with the vertical direction and which divides the interior of the first header tank into inner and outer portions with respect to the left-right direction, and upper and lower closing walls which are provided at upper and lower ends of the partition wall and which close upper and lower end openings of the space located on the inner side of the partition wall with respect to the left-right direction; the refrigerant inflow space is formed by the partition wall and the upper and lower closing walls; and the communication portion, which establishes communication between the lower portion of the refrigerant inflow space and the liquid accumulation space, includes a communication hole formed in the lower closing wall in the form of a through hole.

6. A condenser according to claim 1, wherein refrigerant is caused to flow from a heat exchange path at the upper end of the group toward a heat exchange path at the lower end of the group;

the lower end of the first header tank is located below the lower end of the second header tank; and the first heat exchange tubes which constitute the lower-end heat exchange path of the group and the heat exchange path located below the group are connected to a portion of the first header tank located below the second header tank.

7. A condenser according to claim 1, wherein the first heat exchange tubes which form two heat exchange paths are connected to the first header tank, and the second heat exchange tubes which form at least two heat exchange paths are connected to the second header tank.

8. A condenser according to claim 3, wherein the communication portion is provided below a vertical center of a vertical range in which the first heat exchange tubes communicating with the refrigerant inflow space are disposed.

* * * * *